United States Patent [19]

Hults

[11] 4,121,072

[45] Oct. 17, 1978

[54] SNAP-ACTION OVERCENTER SWITCH HAVING AN APEXED PLUNGER DEPRESSIBLE IN A ROCKABLE ACTUATOR BLOCK

[75] Inventor: Harold W. Hults, New Berlin, Wis.

[73] Assignee: Cutler-Hammer, Inc., Milwaukee, Wis.

[21] Appl. No.: 694,388

[22] Filed: Jun. 9, 1976

[51] Int. Cl.[2] ..... H01H 13/28

[52] U.S. Cl. ..... 200/67 A; 200/67 G; 200/153 L

[58] Field of Search ..... 200/67 A, 67 G, 67 PK, 200/67 R, 68, 77, 153 L, 357, 153 K

[56] References Cited

U.S. PATENT DOCUMENTS

| | | | |
|---|---|---|---|
| 1,346,553 | 7/1920 | Newton | 200/67 A |
| 1,883,128 | 10/1932 | Tregoning | 200/67 A |
| 2,156,989 | 5/1939 | Johnson | 200/67 |
| 2,195,312 | 3/1940 | Hutt | 200/67 |
| 2,269,171 | 1/1942 | Benander | 200/67 A |
| 2,743,330 | 4/1956 | Ludwig | 200/67 |
| 2,780,691 | 2/1957 | Landin | 200/67 G |
| 3,201,538 | 8/1965 | De Vore, Jr. | 200/67 G |
| 3,339,041 | 8/1967 | Rogero | 200/67 |

FOREIGN PATENT DOCUMENTS

| | | | |
|---|---|---|---|
| 1,181,443 | 1/1959 | France | 200/67 G |
| 591,185 | 8/1947 | United Kingdom | 200/68 |
| 755,730 | 8/1956 | United Kingdom | 200/67 A |

*Primary Examiner*—Samuel W. Engle
*Assistant Examiner*—Ralph Palo
*Attorney, Agent, or Firm*—Hugh R. Rather; William A. Autio; Michael E. Taken

[57] ABSTRACT

A snap-action overcenter contact mechanism utilizes a spring-loaded apexed plunger depressibly cammed within a rockable actuator block. The plunger rides in tracks in the block which ensure registered pivotal movement of the block and plunger, and also guides the plunger for depression within the block perpendicular to the pivotal axis thereof. A cam, which may be in the form of a roller mounted to a linearly sliding operator or a toggle lever operator, traverses the plunger to depress the plunger within the block against the bias of compression springs. When the cam translationally crosses the apex of the plunger, the stored energy of the springs is released, and the plunger and block pivot to an alternate position. A positive off feature is also disclosed wherein secondary cams formed on the operator strike the block to force it to pivot to an off position if the first cam has crossed the apex of the plunger and the block has not pivoted to the off position.

15 Claims, 10 Drawing Figures

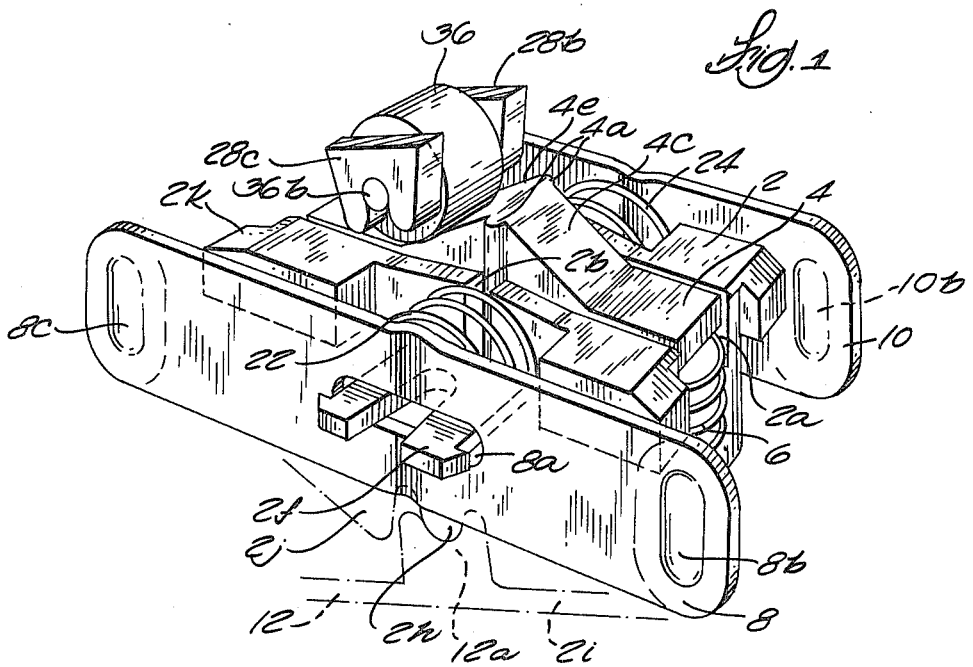
Fig. 1
Fig. 10
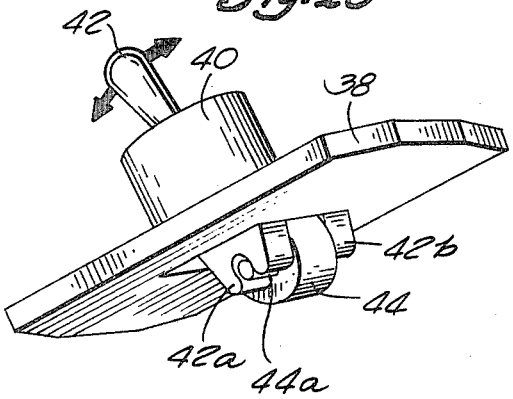
Fig. 9
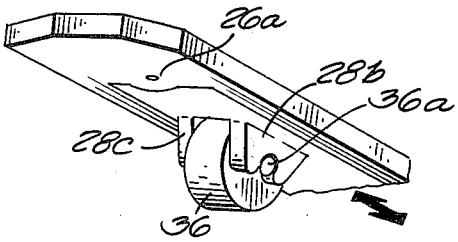
Fig. 2.
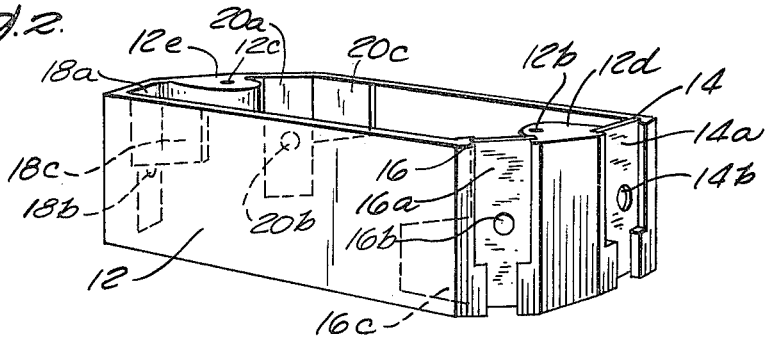

SNAP-ACTION OVERCENTER SWITCH HAVING AN APEXED PLUNGER DEPRESSIBLE IN A ROCKABLE ACTUATOR BLOCK

BACKGROUND OF THE INVENTION

Snap-action overcenter switches are known in the art. These prior switches have suffered one or more disadvantages such as: unreliable operation; short life; possibility of switch failure in the "on" mode; inability to handle high inrush current; limited versatility with respect to operator type; teasing of the contacts at the trip point; and high frictional characteristics. The present invention overcomes these and other disadvantages.

SUMMARY OF THE INVENTION

An object of the invention is to provide an improved snap-action electric switch.

Another object is to provide a switch affording high reliability and long life.

Another object is to provide a switch having high inrush current making ability.

Another object is to provide a switch having little possibility of switch failure in the "on" mode.

Another object is to provide a switch which can be mechanically forced to an "off" position.

Another object is to provide a switch which may be operated by various types of operators.

Another object is to provide a switch which cannot be teased at the trip point thereof.

Another object is to provide a switch having very low frictional characteristics.

Another object is to provide a switch affording wiping contact engagement.

Another object is to provide a switch having controlled contact pressure which is constant until the trip position is reached.

A more specific object of the invention is to provide a snap-action switch adaptable for tool handle use which is highly reliable, affords extremely long life, and has little possibility of switch failure in the "on" mode.

Other objects and advantages will hereinafter appear.

BRIEF DESCRIPTION OF THE DRAWINGS

FIG. 1 is an isolated isometric view of the contacting mechanism of the present invention.

FIG. 2 is an isometric view of the base in which the contacting mechanism of FIG. 1 is housed.

FIG. 9 is an isometric view of a linearly slidable operator mountable to the base of FIG. 2 for actuating the contact mechanism of FIG. 1 housed therein.

FIG. 10 is an isometric view of a toggle lever operator mountable to the base of FIG. 2 for actuating the contact mechanism of FIG. 1 housed therein.

DESCRIPTION OF THE PREFERRED EMBODIMENT

There is shown in FIG. 1 the contacting mechanism of the present invention. This mechanism comprises an actuator block 2 and an apexed plunger 4 depressible into a central channel *2a* formed longitudinally in the block. Each side wall of the channel has a central slot *2b* extending perpendicularly to the pivotal axis of the block to act as a track for receiving and guiding vertically elongated ribs *4a* integrally formed on each side of the plunger and protruding laterally into slots *2b*. The track thus serves to confine the plunger to up-down movement in the block perpendicular to the pivotal axis thereof and also insures pivotal movement of the block and plunger in registry, as will be more fully described hereinafter.

Figure 3:
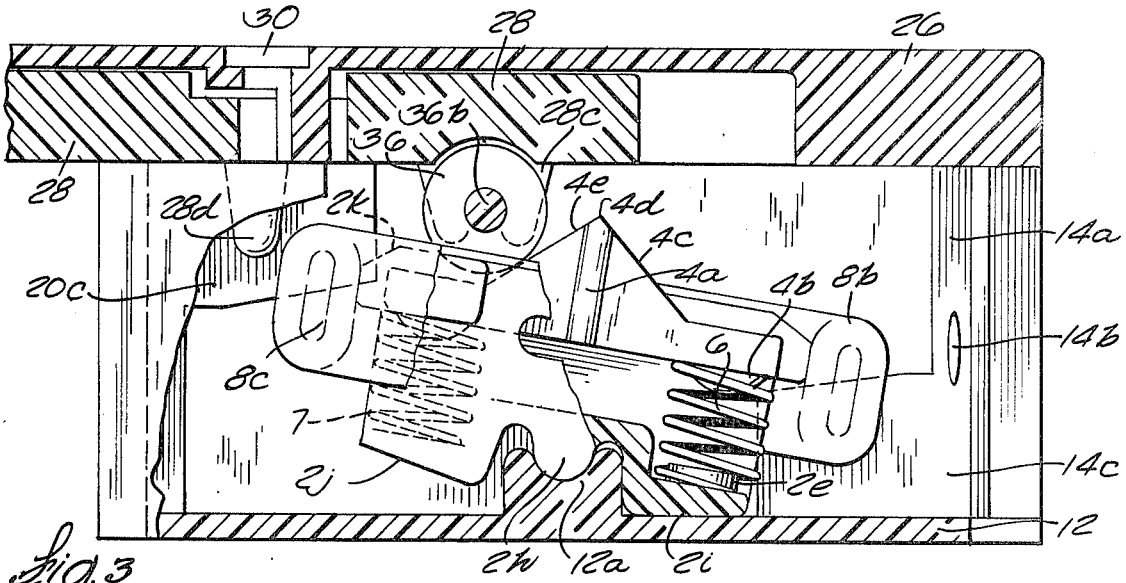
FIG. 3 is a side elevational view, partially broken away, of the base, with the side wall removed, and a linearly slidable operator having a positive off feature, and showing the contacting mechanism in an on position.
Figure 4:
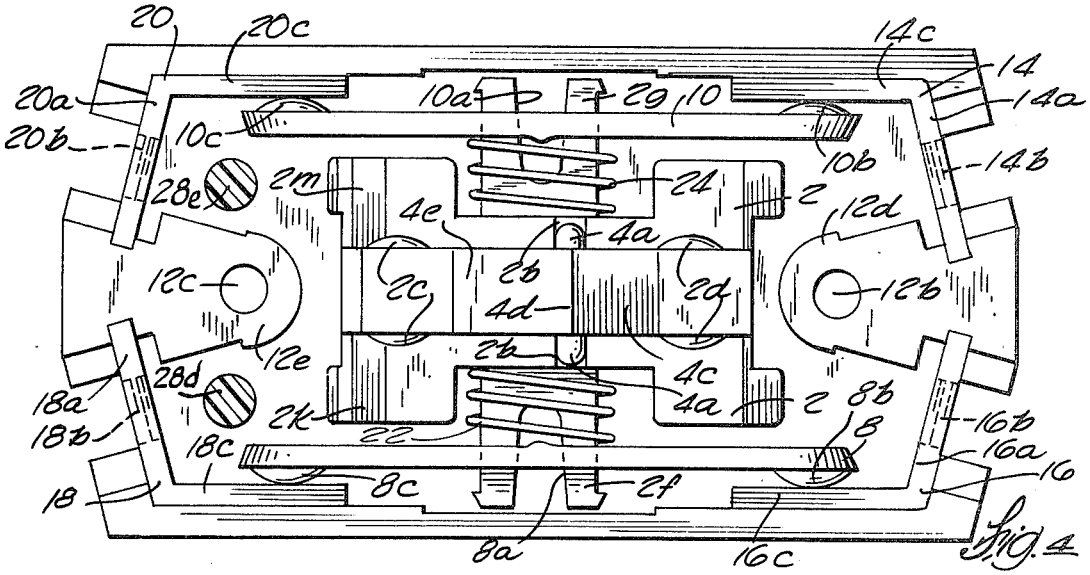
FIG. 4 is a top elevational view of the base and contacting mechanism.

Each side wall of the channel further has an elongated concave detent near each end thereof and complementary to a detent formed in the opposed side wall whereby to form a pair of cylindrical recesses *2c* and *2d*, FIG. 4, extending perpendicularly to the pivotal axis of the block for receiving a pair of helical compression springs 6 and 7, FIG. 3, which bias the plunger externally of the block. As shown in FIG. 3, a nub *4b* may be formed on the underside of the plunger and a nub *2e* may be formed on the bottom wall of the channel in the block to provide further retention of the biasing springs.

The actuator block has a pair of bifurcated ears *2f* and *2g*, FIGS. 1 and 4, extending laterally from the center thereof for carrying conductive bridging contactors 8 and 10. The ears extend through elongated apertures *8a* and *10a* whereby the contactors pivot in registry with the block, as will be more fully described hereinafter.

As shown in FIG. 2, the contacting mechanism is housed within an open-topped base 12 having four L-shaped stationary terminal contact plates 14, 16, 18 and 20 mounted therein. Each contact has a vertical, upright outer portion *14a, 16a, 18a* and *20a* mounted to an end wall of the base by complementary shoulders and grooves formed therein and each of the outer portions has a threaded aperture *14b, 16b, 18b* and *20b* for receiving a screw or the like for attaching a wire or other circuit connection means. Each contact also has an inner portion *14c, 16c, 18c* and *20c*, extending along a side wall of the base, FIG. 4. As shown in FIGS. 2 and 3, portions *14c* and *16c* extend internally of the base adjacent the bottom thereof, while portions *18c* and *20c* extend from the other end wall, internally of the base adjacent the top thereof. Contactors 8 and 10 have rounded protruding surfaces *8b, 8c* and *10b, 10c*, FIGS. 1 and 4, formed near the end thereof for sliding and wiping engagement with the inner portions of the stationary contacts. The contactors are biased outwardly by helical compression springs 22 and 24 mounted coaxially with the ears and bearing between the actuator block and a respective contactor. These springs provide an easily controlled contact pressure source and also provide constant contact pressure right up to the trip point, thus alleviating undesirable diminution of contact pressure just prior to reaching the trip point. The contactors and the stationary contacts may be made of heavy gauge material whereby to afford high current carrying ability.

The actuator block has a bearing 2h formed on its underside by a pair of lateral grooves extending across the bottom of the actuator, FIG. 3. These grooves are flanked by a pair of stopping surfaces 2a and 2j. The bottom horizontal wall of the base has a riased arcuate bearing groove 12a for rockably receiving bearing 2h of the block. This bearing arrangement facilitates positioning of the actuator block in its two position movement with very low frictional characteristics, and also enhances the long life and high reliability characteristics of the switch.

When the block is in the clockwise pivoted position with surface 2i stopped against the bottom of the base, FIG. 3, contactor 10 bridges contacts 14 and 20, and contactor 8 bridges contacts 16 and 18, because, as shown in FIG. 4, surface 10c engages portion 20c, surface 10b engages surface 14c, surface 8c engages surface 18c, and surface 8b engages surface 16c. When the block is in the counterclockwise pivoted position with surface 2j stopped against the bottom of the base, FIG. 6, the contactors 8 and 10 no longer engage the stationary contacts, but rather are biased against the side walls of the base, thus breaking the circuit. There is thus provided a double pole single throw switch. The motion of the actuator block allows the contactors and the stationary contacts to electrically make and break the circuit at points which are different than those which ultimately engage in carrying the electrical load current in the on position. It is also to be noted that the switch affords a double break per pole, i.e. the circuit for each pole is broken in two places, having the desirable advantage of higher voltage interruption capability, for example 220 volts in compliance with foreign standards, and affords a large arc gap.

Figure 5:
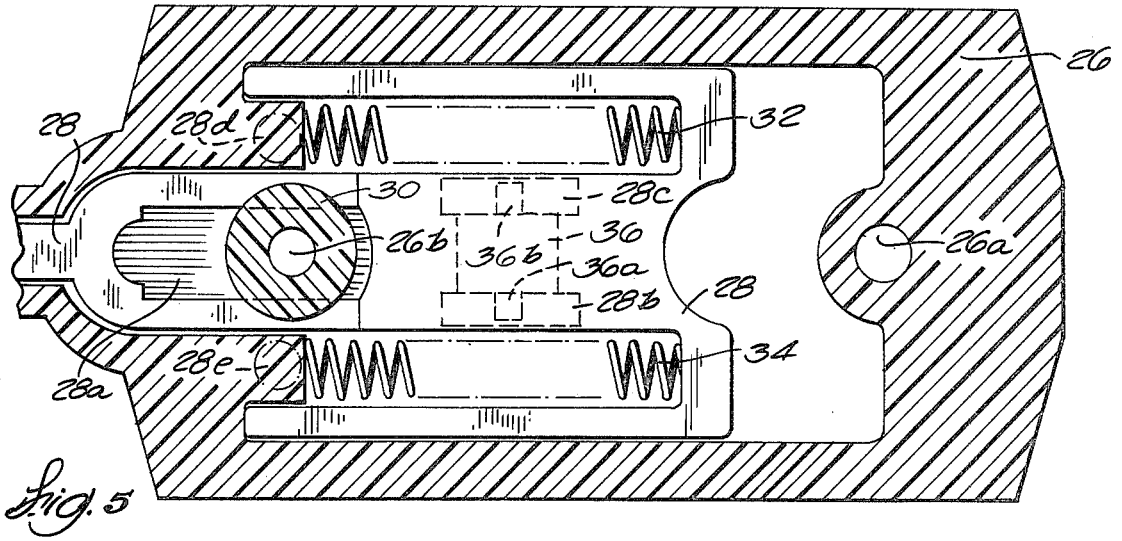
FIG. 5 is a bottom elevational view of the linearly slidable operator of FIG. 3.

As shown in FIGS. 2, 9, 3 and 5, the switch may be operated by a linearly reciprocal member. A cover 26 is mounted to the base by rivets or the like extending through aligned apertures 26a, 12b and 26b, 12c in the cover and upstanding supports, 12d and 12e in the base, FIGS. 4 and 5. Referring to FIGS. 3 and 5, the cover is recessed from below to receive a slider member 28 which is movable left and right. This slider has an elongated aperture 28a through which one of the cover mounting rivets extends together with a retainer pin 30 having an inner annular flange to provide guidance and retention of the slider. The slider is biased rightwardly by a pair of compression springs 32 and 34 bearing between the slider and the cover. The slider may be operated, for example, by an external trigger hingedly hanging therefrom about a fixed pivot whereby the slider is pulled leftwardly upon finger engagement of the trigger, as is well known in the art, for example an overhanging trigger. A pair of supports 28b and 28c extend from the slider into the base for carrying a roller 36 rotatably mounted to the supports by trunions 36a and 36b.

Figure 6:
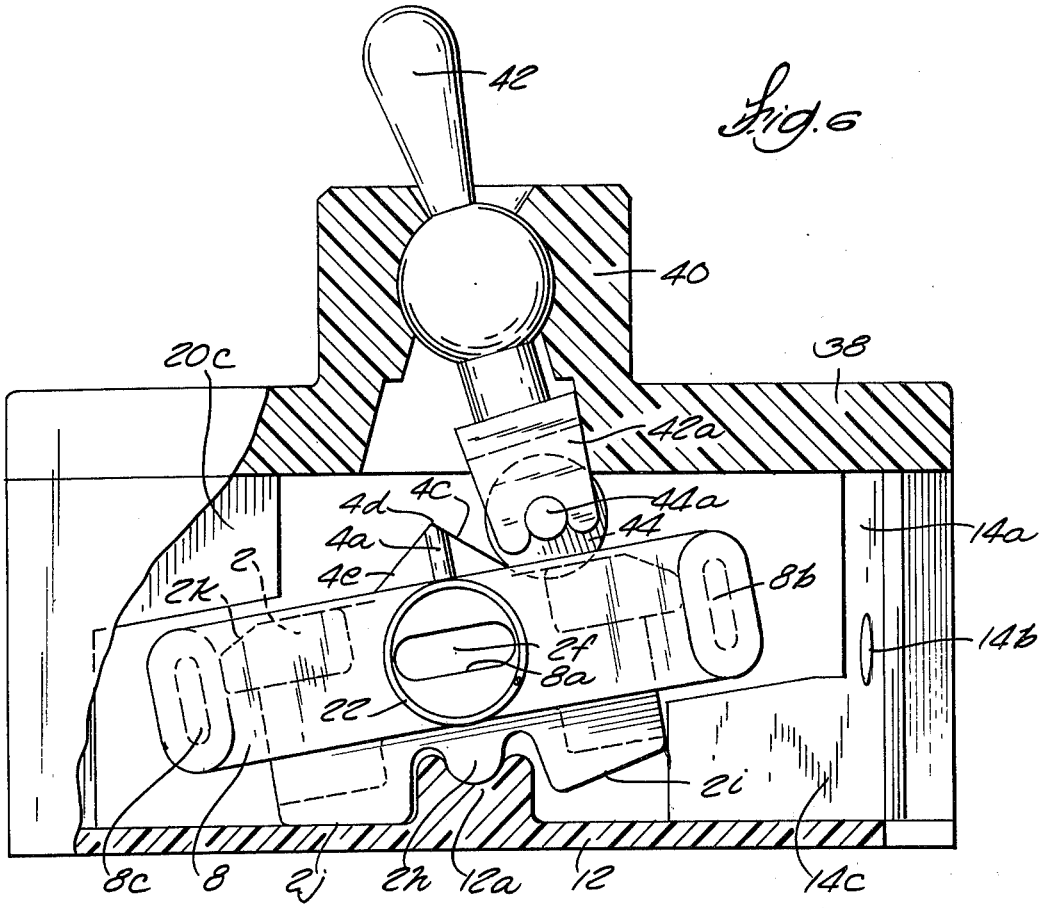
FIG. 6 is a side elevational view with the side wall partially broken away, of the base, and a toggle lever operator, and showing the contacting mechanism in an off position.

As shown in FIGS. 2, 10 and 6, the switch may also be operated by a toggle lever. A cover 38 is mounted to the base similarly to cover 26. Cover 38 has a central aperture above which a mounting bushing 40 is located and through which a toggle lever 42 extends. The toggle lever may be pivotally mounted to the bushing by a generally spherical cavity formed therein complementary to a spherically shaped mid-portion of the toggle lever, or by a pivot pin extending through the bezel and the toggle lever, all as well known in the art. The inner end of the toggle lever has a pair of supports 42a and 42b extending into the base and rotatably mounting a roller 44 about trunions 44a and 44b.

Operation of the switch will now be described. FIG. 6 shows the switch in its off condition. As the roller is moved to the left, either by the toggle lever or the slider member, it will roll along inclined surface 4c of the plunger thereby cammingly depressing the plunger within the actuator block against the bias of springs 6 and 7. When the roller passes the apex 4d of the plunger, the stored energy of compressed springs 6 and 7 is released and the actuator block suddenly pivots clockwise to the position shown in FIG. 3 wherein the roller now engages the inclined surface 4e of the plunger. This snap-action rocking of the actuator block causes sliding and wiping bridging engagement of the contacts wherein contactor 10 completes a circuit between contacts 14 and 20, and contactor 8 completes a circuit between contacts 16 and 18. Return rightward movement of the roller past the apex causes counterclockwise pivoting of the actuator block back to the position shown in FIG. 6. The switch cannot be teased at the trip point because the roller cannot be held on the apex.

Viewing FIGS. 1 and 3, it will be seen that the roller engages the plunger, not the actuator block. This is why the block is in a clockwise pivoted position when the roller is on the left inclined slope 4e of the plunger, thus providing a kind of "reverse" snap-action rocking, in contradistinction to an overcenter snap-action device wherein an actuator block is in a counterclockwise pivoted position when the operator is left of center. It can be seen from FIG. 3 that when the roller is engaging the left slope 4e of the plunger, the springs 6 and 7 will be allowed to expand to a greater extension when the block is in a clockwise pivoted position with surface 2i stopped against the bottom of the base; the block will not assume a counterclockwise pivoted position because such would depress the plunger against the bias of springs 6 and 7.

Rather than being fixed to an overcenter spring, the roller traverses an apexed spring-loaded plunger cammingly depressible in a rockable actuator block. This translational movement of the roller across the apex causes snap-action over-center pivoting of the block.

An advantageous feature afforded by a contact mechanism of the disclosed construction exhibiting "reverse-type" snap-action rocking, is that it may be positively and mechanically forced to an off position without relying on the stored energy of springs 6 and 7. As shown in FIGS. 3 and 5, the slider may be provided with a pair of secondary cams such as nibs 28d and 28e extending into the base to strike inclined surfaces 2k and 2m, respectively, FIGS. 1, 3 and 4, and force the block to pivot to the off position, FIG. 6, if the roller is past the trip point and the actuator block has not snapped to the off position. That is, as the roller is moved rightwardly, FIG. 3, and passes apex 4d, the block should pivot counterclockwise as aforedescribed, but if contact welding or the like, for example, occurs to prevent such, the nibs will strike the block and directly apply the force of the operator to pivot the block because the surfaces 2m and 2k of the block lie in the path of movement of nibs 28d and 28e when the block is in the clockwise pivoted on position. This positive off feature is made possible by the fact that the block is in a clockwise pivoted position when the roller is engaging the left inclined slope of the plunger.

Figure 7:
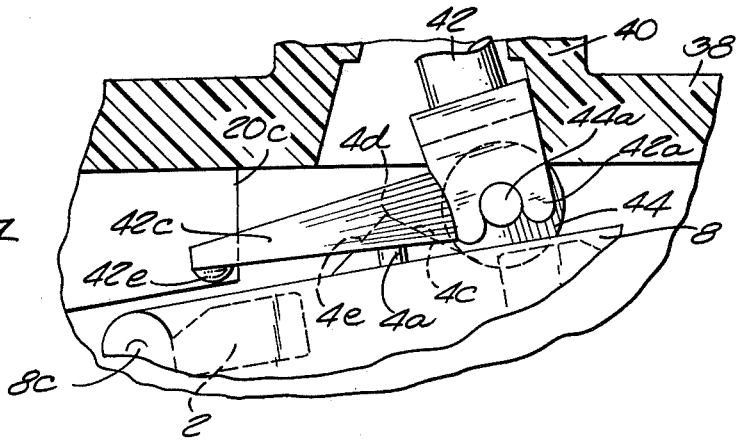
FIG. 7 is partial side elevational view of a toggle lever having a positive off feature.
Figure 8:
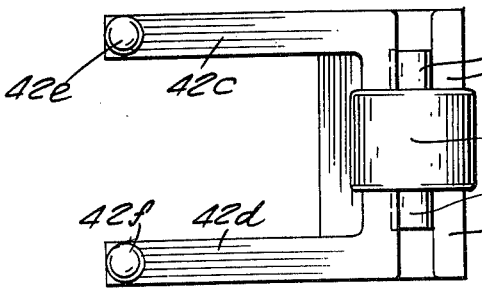
FIG. 8 is a bottom elevational view of the toggle lever of FIG. 7.

The toggle lever may also incorporate a positive off feature. As shown in FIGS. 7 and 8, a pair of spaced arms 42*c* and 42*d* extend leftwardly from supports 42*a* and 42*b* and have camming bumps 42*e* and 42*f* formed on the undersides of the ends thereof for striking the actuator block if the roller is past the apex and the block has not pivoted to the off position.

It can easily be appreciated that other types of operators may be used with the disclosed contact mechanism. For example, any type of operator having a cam which traverses the plunger and cammingly depresses the plunger within the block may be used, whether the cam be a roller or not. Translational movement of a cam across the apex causes the snap-action overcenter pivoting of the block in the directions aforedescribed.

It can also be appreciated that other types of switching contacts may be used. While the bridging contactors are preferred because they provide sliding and wiping engagement, other types of contacts, for example butt closure type, may be carried by the actuator, or various switching mechanisms may be actuated by the rocking of the actuator block.

It can also be appreciated that the aforedescribed secondary cam means for either the trigger or toggle lever can comprise cams formed on either or both sides of the roller whereby to afford a positive off or a positive on or both. A first cam means, such as a roller, is provided to engage the plunger, and second cam means are provided to engage the block. The provision of second cam means ensures that the block will be positively forced to pivot if the first cam means is past the trip point (apex of the plunger) and the block has not pivoted. Depending on the positioning of the second cam means, the block can be positively forced to pivot in either or both directions.

I claim:

1. An electric switch comprising:

housing means;

an actuator block pivotally mounted on said housing means;

an apexed plunger carried by said actuator block for pivotal movement therewith and depressible therein transversely of the pivotal axis thereof;

means biasing said plunger outwardly of said actuator block;

operator means movably mounted to said housing means and having cam means engaging said plunger against the bias of said biasing means and translationally movable across the apex thereof to cause snap-action over-center pivoting of said actuator block when said cam means crosses said apex in response to movement of said operator means; and contact means actuated by said actuator block;

wherein said actuator block has two stable positions, a clockwise pivoted position and a counterclockwise pivoted position, and wherein said plunger has left and right oppositely inclined camming surfaces meeting at said apex, said actuator block being insaid clockwise pivoted position when said cam means is engaging said left inclined surface of said plunger, said plunger being cammingly depressed within said actuator block against the bias of said biasing means by said cam means as said cam means traverses said left inclined surface towards said apex, said actuator block pivoting counterclockwise to said counterclockwise pivoted position when said cam means crosses said apex from said left inclined surface to said right inclined surface, said actuator block being in said counterclockwise pivoted position when said cam means is engaging said right inclined surface of said plunger, said plunger being cammingly depressed within said actuator block against the bias of said biasing means by said cam means as said cam means traverses said right inclined surface towards said apex, said actuator block pivoting clockwise to said clockwise pivoted position when said cam means crosses said apex from said right inclined surface to said left inclined surface.

2. The switch according to claim 1 wherein said operator means has second cam means engageable with said actuator block when said first mentioned cams means has crossed said apex and said actuator block has not pivoted, whereby to positively force said actuator block to pivot in response to movement of said operator means.

3. The switch according to claim 1 wherein said operator means comprises a linearly reciprocal sliding member.

4. The switch according to claim 3 wherein said operator means further has second cam means engageable with said actuator block when said first mentioned cam means has crossed said apex and said actuator block has not pivoted, whereby to positively force said actuator block to pivot in response to movement of said operator means.

5. The switch according to claim 4 wherein said first mentioned cam means comprises a roller rotatably mounted to said sliding member, said second cam means comprises one or more nibs extending from said sliding member, and said actuator block has one or more camming surfaces engageable with said one or more nibs.

6. The switch according to claim 1 wherein said operator means comprises a toggle lever mounted to said housing means and pivotal about an axis parallel to said pivotal axis of said actuator block.

7. The switch according to claim 6 wherein said toggle lever has a middle portion mounted to said housing means, an outer manually engageable portion, and an inner portion, and wherein said cam means comprises a roller rotatably mounted to said inner portion.

8. The switch according to claim 1 wherein said cam means comprises a roller rotatably mounted to said operator means.

9. The switch according to claim 1 wherein said housing means has a bottom wall with a bearing surface and said actuator block has a bearing formed on the underside thereof and seated in said bearing surface for pivotally mounting said actuator block.

10. The switch according to claim 9 wherein said actuator block has a pair of stopping surfaces formed on the underside thereof, flanking said bearing, for engaging said bottom wall of said housing means and limiting the pivotal movement of said actuator block.

11. The switch according to claim 1 wherein said plunger and said actuator block have tracks formed therein for guiding the movement of said plunger within said actuator block and for affording registered pivotal movement of said plunger and said actuator block.

12. The switch according to claim 1 wherein said biasing means comprises a pair of helical compression springs disposed on opposite sides of said pivotal axis and bearing between said plunger and said actuator block.

13. The switch according to claim 1 wherein said contact means comprises sliding and wiping bridging contact means.

14. The switch according to claim 13 wherein said contact means comprises a pair of elongated contactors carried by said actuator block in registered pivotal movement therewith, and stationary contact terminal means mounted in said housing means to be bridged by said contactors upon pivoting of said actuator block.

15. The switch according to claim 14 wherein said housing means has a pair of opposed side walls, said actuator block has a pair of ears extending laterally from opposite sides thereof parallel to said pivotal axis, said contactors have central elongated apertures for mounting said contactors to said ears, and further comprising means biasing said contactors laterally outward from said actuator block against side walls of said housing means in one pivotal position of said actuator block and against said stationary contact terminal means in another pivotal position of said actuator block.

* * * * *